US006688537B2

(12) United States Patent
Boecking

(10) Patent No.: US 6,688,537 B2
(45) Date of Patent: Feb. 10, 2004

(54) INJECTOR LOADED FROM COLLECTING CHAMBER AND PROVIDED WITH CASCADE-SHAPED CONTROL DEVICE

(75) Inventor: Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 252 days.

(21) Appl. No.: 10/033,411

(22) Filed: Nov. 13, 2001

(65) Prior Publication Data

US 2002/0109015 A1 Aug. 15, 2002

(30) Foreign Application Priority Data

Nov. 13, 2000 (DE) ..... 100 56 165

(51) Int. Cl.[7] ..... F02M 41/16; F02M 45/10; B05B 1/14; B05B 1/30

(52) U.S. Cl. ..... 239/96; 239/95; 239/91; 239/533.3; 239/585.5

(58) Field of Search ..... 239/88, 89, 90, 239/91, 95, 96, 124, 127, 533.2, 533.3, 585.1, 585.2, 585.3, 585.4, 585.5; 251/127, 129.15, 129.21

(56) References Cited

U.S. PATENT DOCUMENTS 4,170,976 A * 10/1979 Eckert et al. ..... 123/387
4,462,275 A * 7/1984 Mohl et al. ..... 477/43
4,712,528 A * 12/1987 Schaffitz ..... 123/446
4,805,715 A * 2/1989 Deike et al. ..... 180/197
5,628,293 A 5/1997 Gibson ..... 123/446
5,945,596 A * 8/1999 Burkel et al. ..... 73/118.1

FOREIGN PATENT DOCUMENTS

DE 198 35 494 A1 2/2000
EP 0 657 642 A2 6/1995

* cited by examiner

*Primary Examiner*—Davis Hwu
(74) *Attorney, Agent, or Firm*—Michael J. Striker

(57) ABSTRACT

An injection for injecting fuel under high pressure in a combustion chamber of an internal combustion engine has a control chamber, a valve body which is pressure loaded from the control chamber, a further control chamber, a nozzle needle which is pressure loaded from the further control chamber, a nozzle inlet, a nozzle chamber provided for the nozzle needle and loaded from the nozzle inlet, a valve body formed as a 3/2-way valve for pressure controlling the injector, a 2/2-way valve for stroke controlling of the injector at a leakage oil side, and a common controller, the valves being controllable either by the common controller or separately from one another.

14 Claims, 2 Drawing Sheets

INJECTOR LOADED FROM COLLECTING CHAMBER AND PROVIDED WITH CASCADE-SHAPED CONTROL DEVICE

BACKGROUND OF THE INVENTION

The present invention relates to injector loaded from collecting chamber and provided with cascade-shaped control device.

Fuel injection systems which are designed with high pressure collection chambers (common rail) must satisfy in addition to the requirements such as longevity and favorable manufacturing costs, also the requirements of accurate dosing of the injection quantity as well as maintaining of a constant injection pressure for all injectors at all times. Injection pressure and injection quantity must be determined for each operational pressure and each injection quantity of the internal combustion engine independently from one another, so that for the mixture formation and additional freedom decree is provided. The injection quantity at the beginning of the injection must be as small as possible, to take into account the injection delay up to complete formation of the flame front in the combustion chamber of the internal combustion engine. In high pressure collecting chambers (common rail) pressure fluctuations occur due to the pump supply and injection process, and are damped by the storage volume.

U.S. Pat. No. 5,628,293 deals with an electronically controlled fuel injection with a fluid collecting chamber which is loaded by a pre-injection and has a directly controllable element for releasing the connecting line between the fluid collecting chamber and the injection nozzle which extends into the combustion chamber of an internal combustion engine. In addition to the first directly controllable injection element, a further pressure control element is reciprocatingly movable between two adjusting positions. With the both switchable pressure control elements, hydraulic forces which are opposed to one another are balanced.

In this configuration from the prior art, there is a disadvantage that the control of the pressure elements is performed by two units which, in the case of failure of the control device, can only partially secure against overpressure or an adjustable overquantity.

German patent document DE 198 35 494 A1 discloses a pump-nozzle unit. It serves for fuel supply in a combustion chamber of the direct injection internal combustion engine. It includes a pump unit for forming an injection pressure and for injection of the fuel via an injection nozzle into the combustion chamber. Furthermore, a control unit is provided, which acts on a control valve formed as an outwardly open A-valve. Moreover, a valve actuation unit is provided for controlling the pressure buildup in the pump unit. For providing a pump-nozzle unit with a control unit which has a simple construction, is small and has especially short response time, it is proposed in this reference to form the valve actuating unit as a piezoelectric actuator.

The European patent document EP 0 657 642 A2 deals with a fuel injection device for internal combustion engines. The fuel injection device disclosed in this document has a high pressure collecting chamber which is fillable by fuel pressure pump, and from which high pressure lines extend to individual injection valves. In the individual high pressure lines, control valves for controlling the high pressure injection valves as well as an additional pressure storage chamber between these control valves and the pressure collecting chamber are provided. In order to avoid application of the high system pressure continuously on the injection valves, the control valve is formed so that during the injection pauses at the injection valve its connection to the pressure storage chamber is closed and the connection between the injection valve and release chamber is controlled.

SUMMARY OF THE INVENTION

Accordingly, it is an object of the present invention to provide an injector loaded from collecting chamber and provided with a cascade-shaped control device, which avoids the disadvantages of the prior art.

In keeping with these objects and with others which will become apparent hereinafter, one feature of present invention resides, briefly stated, in a injector loaded from a collecting chamber and provided with a cascade-shaped control device, which has means forming a control chamber; a valve body which is pressure loaded from said control chamber; means forming a further control chamber; a nozzle needle which is pressure loaded from said further control chamber; a nozzle inlet; a nozzle chamber provided for said nozzle needle and loaded from said nozzle inlet; a valve body formed as a 3/2-way valve for pressure controlling the injector; a 2/2-way valve for stroke controlling of the injector at a leakage oil side; and a common controller, said valves being controllable either by said common controller or separately from one another.

With the inventive solution, an injector for injecting fuel under high pressure into the combustion chambers of an internal combustion engine is provided, in which with one controller simultaneously two servo valves are actuated and thereby a stroke-/pressure control injector is provided. By means of a pressure member which is common for both closure elements, both the valve body inside of the injector is controlled, and also simultaneously the outlet throttle of a control chamber above a stroke part of the injector is relieved. The thereby released inlet from the high pressure collecting chamber (common rail) loads both the nozzle chamber which directly surrounds the nozzle needle in the region of a pressure stage, and simultaneously the further control chamber which is located above the nozzle needle. It is loaded during controlling the inlet from the high pressure collecting chambers so that, high pressure from the high pressure collecting chamber is provided at the nozzle needle chamber. Due to the direct coupling of the both systems, namely a pressure-controlled and a stroke-controlled system, two principles inside the injector are coupled, which allow a pressure and a stroke-controlled injection process.

With the present invention an injection process which is approximately ideal for a utility vehicle is provided. During the pressure raise flank at the injector, a pressure-controlled injector is required to make available fast the required high pressure at the injection opening, while during the closing process and for a post-injection in the combustion chamber of an internal combustion engine a stroke-control led system is used so as to supply an injection nozzle for a fast relieve of the nozzle-chamber. With the inventive coupling of the both pistons of a 3/2-way valve and a 2/2-way control-valve, both control principles can be used in an injector. During the pressure buildup phase a pressure control takes place, while during the closing process and the post-injection a stroke control of the inventive injector can be performed.

In accordance with a further embodiment of the present invention, with a combination of a 3/2-way valve and a 2/2-way valve, pressure side and leakage oil side of an injector can be separated from one another. Also, with such an injector for injection of fuel during high pressure in the combustion chambers of an internal combustion engine, it can operate so that a pressure control and a stroke control of the injector can be realized during various injection phases. The pressure buildup in this embodiment is performed through a valve provided at the leakage oil side. With this injection configuration, during fully open control part the system can be controlled and during partially open control part a stroke control can be performed. Also a post-injection can be realized which can be performed at high pressure for optimizing the course of the combustion process.

The both embodiments of the inventive injector configuration allow the use of two control principles, whose advantages during the pressure buildup and during the closing process or a post-injection can be combined with one another, to satisfy the requirements of the injection characteristics, for example in utility vehicles, in an improved way.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
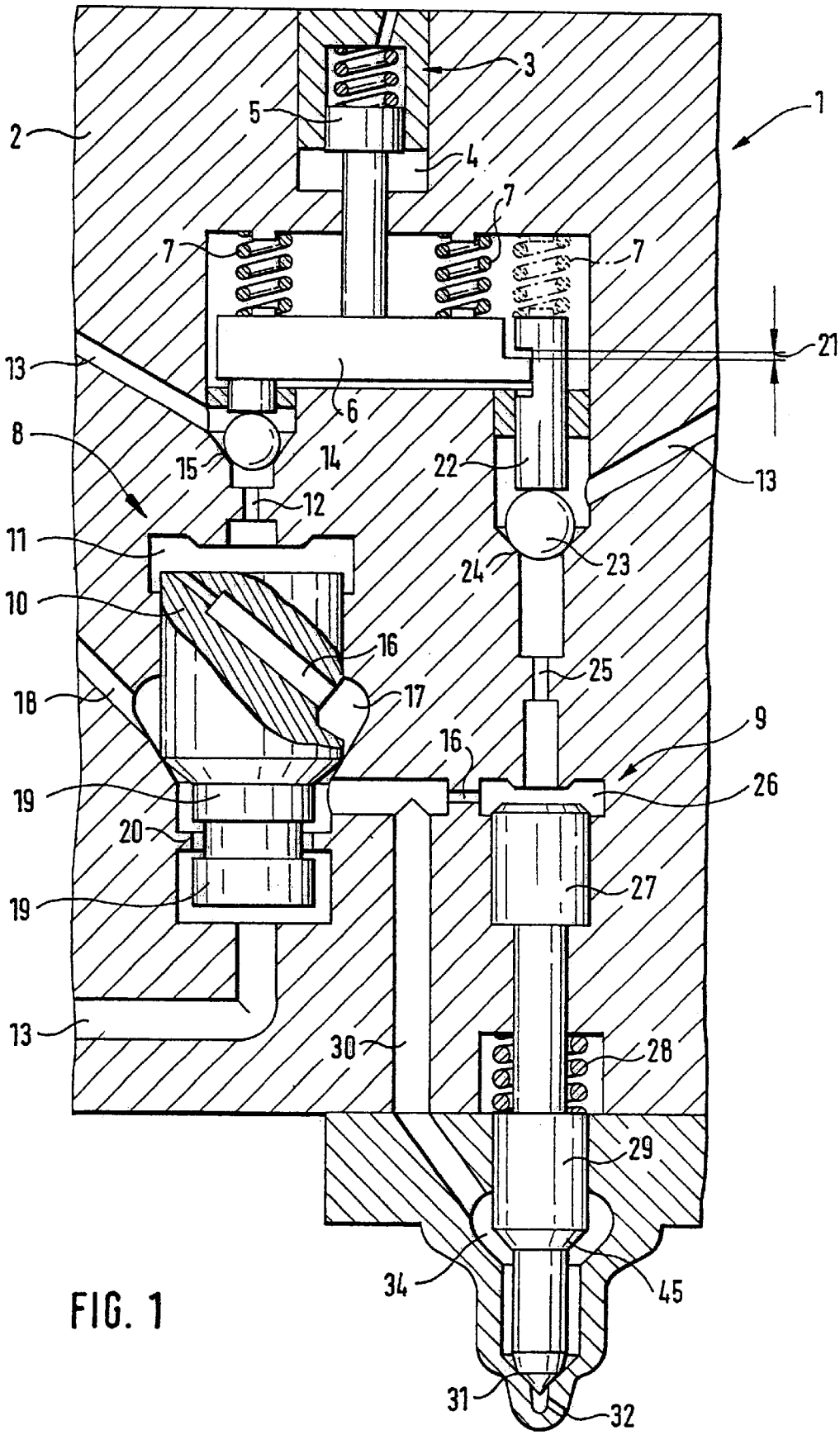
FIG. 1 is a view showing an actuating unit which acts simultaneously on control valves of an injector and includes a pressure-controlled and a stroke-controlled part.

FIG. 1 shows an injector which has a pressure-controlled part and stroke-controlled part, actuatable simultaneously by an actuator. The injector 1 shown in FIG. 1 has an injector housing 2 in which a pressure part 8 as well as a stroke part 9 of the injector are arranged.

A common piezocontroller is provided in the upper end of the injector and is identified with reference numeral 3. A pistons which is reciprocatingly movable in a vertical direction and provided with a hydraulic multiplier or convertor cooperates with the piezocontroller. The piston 5 of the piezo controller 3 is connected with a pressure element 6 which loads both the pressure part 8 and the stroke part 9. The pressure element 6 is pre-stressed by a spring pair 7 which alternatively can be a single spring 7. A pressure element 22 which loads a further 2/2-way control valve 23 is located on a pressure element 7 which is received symmetrically to the piezocontroller 3. The pressure element 22 communicates with at an opening with the projection of the pressure element 6. Therefore the pressure element 6 which is arranged at the piston rod of the piston 5 of the common piezocontroller provides the pressure rod 22 with a maximum stroke path.

A closure element 14 is arranged in the injector housing 2 under the common piezocontroller 3 which can be formed as a piezoactuator. The closure element 14 closes its seat 15. The closure element 14 is actuated through a pressure element which is loaded by the sealing spring pair 7 shown in FIG. 1. The ball-shaped closure element moves out of its seat 15 in the injector housing 2 during pressure relief against the action of the sealing spring 3. The opening of the injector housing 2 which is closable by the ball-shaped closure element 14 communicates with the interior of a control chamber 11 through an outlet throttle 12. The control chamber 11 is continuously loaded with fuel by an inlet throttle element 16 which is formed as a valve body 10 operating as a 3/2-way valve. The valve chamber 17 which surrounds the valve body 10 is provided with a continuous high pressure through the inlet 18 from the high pressure collecting chamber (common rail) so that it is guaranteed that in the control pleasure 11 always a sufficient control volume is available.

A slider stage 19 is formed under the seat of the valve body 10 in the injector housing 2 on the valve body 10. It cooperates with a control edge 20 formed in the injector housing 2. The lower region of the slider stage 19 is enclosed by a leakage oil chamber formed in the injector housing 2, through which a leakage oil line 13 branches for example into the fuel reservoir.

A nozzle inlet 30 extends into a nozzle inlet 34 at a high pressure side from the upper slider stage 19. The nozzle inlet 34 surrounds a nozzle needle 29 which is formed of one piece, in the region of its pressure stage 45. In the condition shown in FIG. 1, the nozzle needle 29 sits on the nozzle seat 31 in the injector housing and closes an injection opening 32 provided in the nozzle tip.

The needle 29 which is formed as a one-piece member is arranged coaxially to the valve body 10 formed as a 3/2-way valve, in the injector housing 2 of the injector 1. The diameter extending from the pressure stage 45 in the region of the nozzle chamber 34 extends in a vertical direction upwardly into a constriction surrounded by a spring element acting as a sealing spring. The spring element 28 in turn is surrounded by a hollow chamber formed in the injector housing 2. A nozzle needle piston 27 is formed on the head of the nozzle needle 29. Its end surface extends into a further control chamber 26 inside the injector housing 2. The further control chamber 26 inside the injector housing 2 is supplied with fuel under high pressure through a branch in which an inlet throttle element 16 is integrated. At the outlet side, a ventilation nozzle 25 is associated with a further control chamber 26 which opens into a housing opening inside the injector housing 2. It is closed in turn by a 2/2-way valve 23 at its seat surface 24. The closure element of the 2/2-way valve in turn is loaded by a pressure rod 22 at the ball-shaped closure body 23. A separate sealing spring, analogously to the adjusting spring 7 of the pressure element 6, can be associated with the pressure rod 22.

A stroke path of the pressure rod 22 is identified with reference numeral 21. A leakage oil line 13 branches from the receiving opening of the independently controllable 2/2-way valve, which supplies volumes exiting the further control chamber 26 for example to a fuel reservoir.

The operation of the injector for injection of fuel into the combustion chamber of the internal combustion engine shown in FIG. 1 is performed in the following manner.

When the piezocontroller 3 formed for example as the piezoactivator is supplied with current, the common control element 6 moves against the action of the sealing spring 7 in a vertical direction upwardly. Depending on the current supply to the actuator, the corresponding vertical stroke movement of the common pressure element 6 is performed. When the common pressure element 6 is extended in a vertical direction upwardly against the action of the sealing spring 7, the pressure part 8 of the inventive injector 1 performs an extension movement of the upper end surface of the valve body 10 which serves as the 3/2-way valve into the control chamber 11. Thereby the valve body 10 opens at its seat surface and the inlet 18 from the pressure collecting chamber is released. Thereby fuel under high pressure in the nozzle inlet 30 is provided at the nozzle inlet 34 and thereby at the tip of the injection nozzle. In this condition the nozzle needle 29 is introduced into its nozzle seat 31. When the stroke path of the common pressure element 6 produced by the current supply of the common pressure element 3 is greater than the stroke path of the projection of the common pressure element 6 identified with reference numeral 21 in the recess of the pressure rod 22, the closure element 23 which acts at the 2/2-way valve opens its seat surface 24. Through the outer throttle 25, the volumes supplied from the inlet throttle 16 to it can flow from the further control chamber 26 at the leakage oil side. Thereby in the further control chamber 26 no pressure is built up, so that the injector or in other words the vertical movement of the nozzle needle 29 can be pressure-controlled.

When to the contrary the common piezoactuator 2 is controlled so that the stroke 3 covered by the common control element 6 in the vertical direction opposite to the action of the sealing spring 7 is smaller than the stroke path identified with reference numeral 21, than the pressure rod 22 remains stationary with the receptacle and the ball-shaped closing element 23 operating as a 2/2-way valve remains in its position which closes the sealing seat 24. Thereby no control volume can flow through the outlet throttle 25 from the further control chamber 26, a pressure is built up in it and acts on the end surface of the nozzle piston 27 extending in the further control chamber 26. In this condition the nozzle needle 26 is stroke controlled.

When contrary to the showing of FIG. 1, the injector is completely closed, or in other words the common piezocontroller 23 is not supplied with power, the system is unloaded through the secondary side, or in other words in the region of the slider stage 19 at the valve body 10 formed as a 3/2-way valve. The nozzle inlet 30 and thereby the nozzle chamber 34 of the injector can be pressure-unloaded due to the part of the valve body 10 formed as the slider stage. With the inventive solution the injector composed of the pressure part 8 and the stroke part 9 can operate with the stepped current supply of the common piezo controller 3 so that, the system first runs in a pressure-controlled fashion until the stroke path 21 is exceeded. At this time point, the nozzle needle 29 which moves in the nozzle seat 31 performs the full running, or in other words fuel under high pressure which is in the inlet from the high pressure collecting chamber 18 fills the whole line system which is available and reachable up to an injection line 32 of the injector. With a further current supply of the common piezocontroller and exceeding of the stroke path 21, a further extension movement of the common pressure element 6 against the action of the sealing springs is performed and the injector is stroke-controlled. Thereby the injection characteristics for the internal combustion engines of utility vehicles can be taken into consideration to a high degree. During the pressure rising flank, a pressure-controlled injector (the pressure part 8) is extended, while during closing of the nozzle needle and for an eventually performed post-injection, a stroke-controlled system (stroke part 9) of an injector is advantageous. With the inventive solution, both systems can be provided in one injector, so that during the individual injection phases the advantages of both systems can be utilized.

In the injector for injection of fuel in the combustion chambers of the internal combustion shown in FIG. 1, a 3/2-way valve as well as a separate 2/2-way leakage oil valve are provided.

Figure 2:
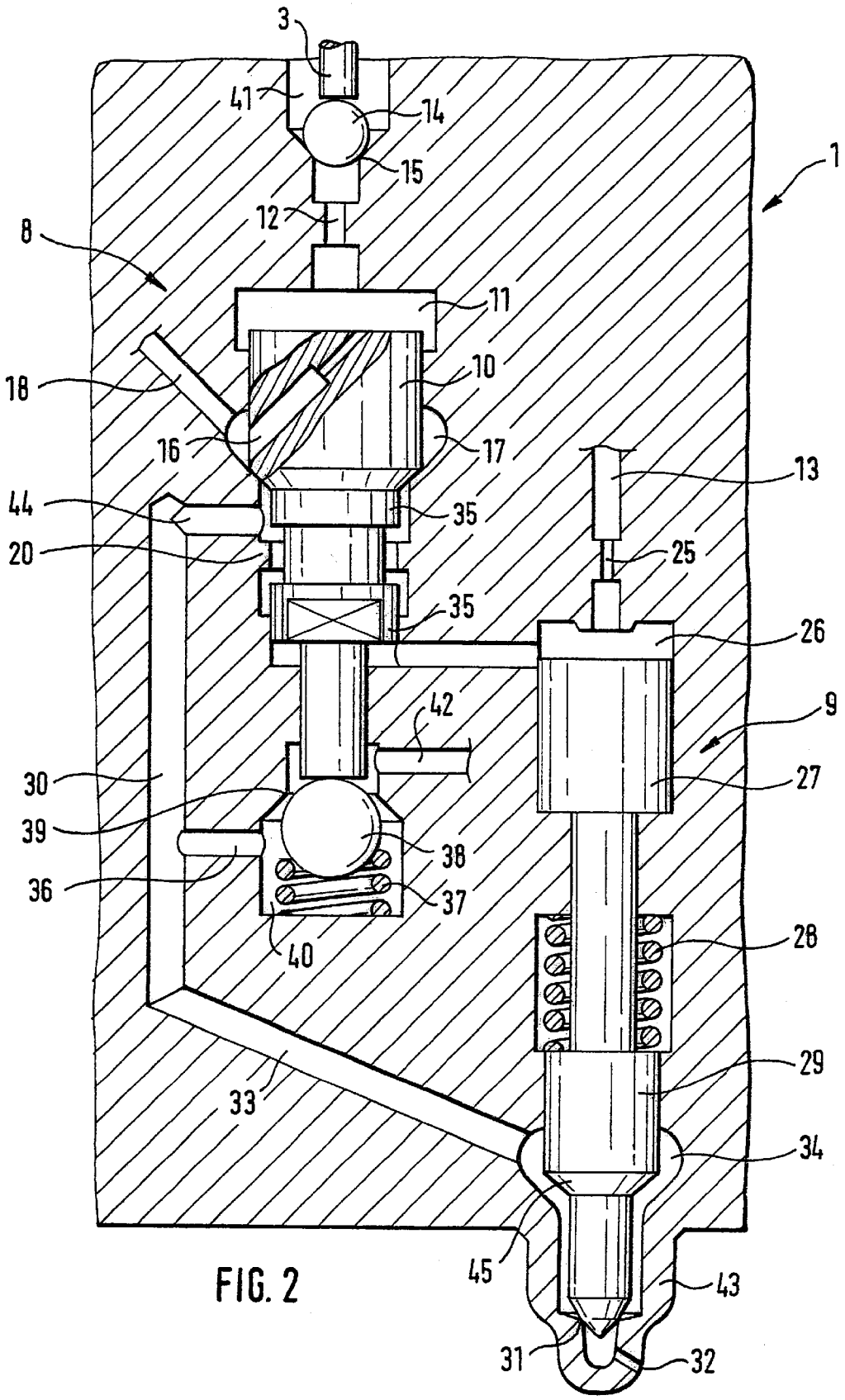
FIG. 2 is a view showing an injector for injecting fuel in the combustion chambers of an internal combustion engine, with a pressure side and a leakage oil side which are separated from one another.

Analogously to the embodiment of FIG. 1, the injector 1 of FIG. 2 is subdivided into a pressure part 8 and a stroke part 9. A control chamber 11 is formed above one of the valve bodies 10 operating as a 3/2-way valve. The control chamber 11 is continuously loaded from the inlet 18 from the high pressure collecting chamber (common rail) with fuel under high pressure, through an inlet nozzle 16 provided in the valve body 10 and through the valve chamber 17 from the supply 18. A pressure release of the control chamber 11 above the end surface of the valve body 10 can be performed by controlling of a ball-shaped body operating as the closure element 14, by the current supply to a piezocontroller 3. During a vertical extension of the ball-shaped closure element 14 from its seat surface 15, a part of the control volume of the control chamber flows out, so that in the valve body 10 received in an opening of the housing, a vertical extension movement in the control chamber 11 is provided.

Fuel under high pressure in the nozzle chamber 34 surrounding the nozzle needle 29, which is produced in the inlet 18 from the high pressure collecting chamber (common rail) through the opening 44 in the nozzle inlet 33 and the opening of the inlet 33, acts in the valve chamber 17 formed in the injector housing 2 when the valve body 10 is moved upwardly. A pressure stage 45 is formed inside the nozzle chamber 34 in the injector housing 2. The nozzle needle 29 is formed as a one-piece component and arranged in FIG. 2 in its nozzle seat 31, so that the injection opening 32 for fuel supply is cut off.

A two-stage slider stage 35 is provided on the valve body 10 which operates as a 3/2-way valve in FIG. 2. The two-stage slider stage 35 cooperates with a control edge 22 provided in the housing. An inlet from the opening of the valve body 10 to a further control chamber 26 extends under the two-stage slider stage 35 formed in the valve body 10. The control chamber 26 is also formed in the housing 2 of the injector 1 and is pressure-unloadable through a leakage oil valve 13 coupled with the vertical movement of the valve body 10, through the outlet throttle 25. The end surface of a nozzle needle piston 26 extends into the further control chamber 26 in the injector housing 2 and is formed on a nozzle needle 29. The nozzle needle 29 is loaded in an increased diameter region by a sealing spring supported in the housing, analogously to the embodiment of FIG. 1.

When the control chamber 11 is unloaded in the injector housing 2 by actuation of the piezocontroller 3 and release of the outlet opening, the valve body 10 which acts as a 3/2-way valve moves with its end surface upwardly into the control chamber 11. Thereby fuel under high pressure flows via the inlet 18 from the high pressure collecting chamber (common rail), into the valve chamber 17 and from there through the transverse opening 34 in the nozzle inlet 30 and thereby into the nozzle chamber surrounding the nozzle needle 29. Simultaneously the leakage oil valve 13 is closed by a mechanical coupling. During a partial closure of the valve body 10 which acts as a 3/2-way valve, the pressure produced from the high pressure collecting chamber flows out and into the further control chamber 26 in the injector housing 2. There the nozzle needle piston 27 is loaded with this pressure. An outlet throttle element 25 is associated with the further control chamber 26 for pressure relief. It allows or prevents the pressure relief of the further control chamber 26 via the leakage oil valve 13 which is coupled with the vertical movement of the valve body 10. When due to the pressure build up in the control chamber 11 the valve body 10 operating as a 3/2-way valve moves back to its seat in the injector housing 10, in other words the inlet 18 moves from the high pressure collecting chamber, the leakage oil valve 13 opens. The pressure acting in the system is pressure relieved at the leakage oil side through the further control chamber 26 which is connected with the slider stage 35 of the valve body 10 and thereby unloads the pressure inlet 30, 44. With this configuration when the valve body 10 operating as a 3/2-way valve is fully open, the system is operated in a pressure-controlled fashion, and with a partially open valve body 10 the injector is operated via the stroke part 9 in a stroke-controlled manner, at least for a post-injection with high pressure levels.

With the features of the embodiment of FIG. 2, very compact combination of a 3/2-way valve with a 2/2-way leakage oil valve 13 can be provided. The further control chamber 26 through which the nozzle needle piston 27 is loaded, is controlled at the primary side by the slider stage 35 of the valve body 10 which acts as a 3/2-way-valve. This has the advantage that all control valves can be located one after the other on one axis, so that a simple construction of a control chamber in the injector housing 2 for receiving the nozzle needle combination can be provided. Also, in the embodiment of FIG. 2 both a pressure-controlled and a stroke-controlled injection system is provided, wherein with the 3/2-way valve the pressure side can be connected and with the 2/2-way valve 13 the leakage side of the inventive injector can be connected. With the embodiment of FIG. 2, also an injection characteristic which is usable for utility vehicles is provided, which both realizes pressure-controlled injection phases and stroke-controlled injection phases.

It will be understood that each of the elements described above, or two or more together, may also find a useful application in other types of constructions differing from the types described above.

While the invention has been illustrated and described as embodied in injector loaded from collecting chamber and provided with cascade-shaped control device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

What is claimed is:

1. An injection for injecting fuel under high pressure in a combustion chamber of an internal combustion engine, comprising means forming a control chamber; a valve body which is pressure loaded from said control chamber; means forming a further control chamber; a nozzle needle which is pressure loaded from said further control chamber; a nozzle inlet; a nozzle chamber provided for said nozzle needle and loaded from said nozzle inlet; a valve body formed as a 3/2-way valve for pressure controlling the injector; a 2/2-way valve for stroke controlling of the injector at a leakage oil side; and a common controller, said valves being controllable either by said common controller or separately from one another.

2. An injection as defined in claim 1, wherein said valve body has an inlet throttle element through which said first-mentioned control chamber is connected permanently with an inlet from a high pressure collecting chamber.

3. An injection as defined in claim 1, wherein said valve body has slider portions which are provided with a control edge for controlling a high pressure.

4. An injection as defined in claim 1; and further comprising an injector housing provided with a seat for said valve body, and an opening which communicates with a pressure-releasing control chamber and acts on a nozzle needle piston.

5. An injection as defined in claim 1; and further comprising a supply throttle element integrated in an inlet to said further control chamber in said injector housing.

6. An injection as defined in claim 1; and further comprising a pressure element acted by said controller which is common for said pressure part and said stroke part for acting on a closure element and providing a maximum stroke path of a pressure rod coupled with said pressure element.

7. An injection as defined in claim 1, wherein said further control chamber is pressure relieved by controlling a closing element when said common controller has a greater stroke path than a stroke path of a pressure rod, so as to pressure control the injector.

8. An injection as defined in claim 1, wherein a closure element is closed when said common controller provides a smaller stroke path of a pressure element than a predetermined stroke path, so as to control the injector in a stroke-controlled manner.

9. An injection as defined in claim 1, wherein said common controller is a piezoactuator.

10. An injection as defined in claim 1, wherein said valve body has a slider portion formed so that during a partial closing of said valve body via said slider portion said further chamber is acted with a high pressure and a closure piston loads said nozzle needle.

11. An injection as defined in claim 1; and further comprising an outlet throttle providing a pressure relief of said further control chamber.

12. An injection as defined in claim 1, wherein said valve body which acts as a 3/2-way valve performs a vertical movement which is mechanically coupled with an opening and closing movement of said 2/2-way valve.

13. An injection as defined in claim 1, wherein said valve body has a slider portion and an unloading opening located under said slider portion and branching from said nozzle inlet to said nozzle chamber, and a closure element which is coupled with a vertical movement of said valve body inside an injector housing.

14. An injection as defined in claim 1, wherein said nozzle needle is movable as a single component with a nozzle needle piston acted through said further control chamber and a pressure stage from a nozzle seat.

* * * * *